US006237674B1

(12) United States Patent
Larkin et al.

(10) Patent No.: US 6,237,674 B1
(45) Date of Patent: May 29, 2001

(54) SPOKED SUPPORT RING FOR AIR PREHEATER HOUSING

(75) Inventors: James R. Larkin; Kevin J. O'Boyle; Michael Zakel, all of Wellsville, NY (US)

(73) Assignee: Alstom Power N.V., Amsterdam (NL)

( * ) Notice: Subject to any disclaimer, the term of this patent is extended or adjusted under 35 U.S.C. 154(b) by 0 days.

(21) Appl. No.: 09/666,995

(22) Filed: Sep. 21, 2000

(51) Int. Cl.[7] ..... F28D 17/00
(52) U.S. Cl. ..... 165/10; 165/8
(58) Field of Search ..... 165/4, 6, 8, 9, 165/10

(56) References Cited

U.S. PATENT DOCUMENTS 4,063,587 * 12/1977 Stockman ..... 165/8
5,362,449 * 11/1994 Hedenhag ..... 165/8
5,535,813 * 7/1996 Snider ..... 165/8
5,628,360 * 5/1997 Brophy et al. ..... 165/9
5,655,594 * 8/1997 Wonderling ..... 165/9
6,091,061 * 7/2000 Dreisler et al. ..... 165/8
6,145,582 * 11/2000 Bolle et al. ..... 165/8

* cited by examiner

*Primary Examiner*—Christopher Atkinson
(74) *Attorney, Agent, or Firm*—Alix, Yale & Ristas, LLP

(57) ABSTRACT

A rotary regenerative air preheater has ring assemblies at the upper and lower ends which define the outer periphery and support the air preheater housing panels. The ring assemblies are spaced by spokes which are tied to the hub of the air preheater and vertically supported from the air preheater structural members. The rotor housing panels are attached around and between the spoked ring assemblies. The ring assemblies are formed form a series of uniform interchangeable segments and they support the peripheral bypass seals.

7 Claims, 4 Drawing Sheets

SPOKED SUPPORT RING FOR AIR PREHEATER HOUSING

BACKGROUND OF THE INVENTION

The present invention relates to rotary regenerative heat exchangers and more particularly to the rotor housing and the housing support.

A rotary regenerative heat exchanger, conventionally used as an air preheater for combustion equipment, is composed of a rotor, containing heat exchange surface, which is usually mounted on a vertical shaft for rotation within a heat exchanger housing which surrounds the rotor. Extending across the heat exchanger on the lower end below the housing, normally the cold end, is a cold end center section which serves as a support for the entire heat exchanger structure including the rotor. Extending across the top of the heat exchanger, above the housing and parallel to the cold end center section, is a hot end center section. This hot end center section functions as the mounting means for the upper end of the rotor shaft. The hot end center section is supported by main support pedestals on each end of the hot end center section which are, in turn, supported on the ends of the cold end center section.

The conventional housing for large air preheaters comprises a plurality of housing panels arranged around the periphery of the rotor. See U.S. Pat. Nos. 5,655,594 and 5,628,360. Typically there are eight or more sides. Mounted on the inside of each housing panel between the panels and the rotor are arch-shaped stiffeners which cooperate to form a close fitting circular flange around the rotor. Conventional bypass sealing means are provided between the rotor and these archshaped stiffeners to prevent the by-pass of air or flue gas around the outside of the rotor.

Attached to each end of the heat exchanger housing are the air and gas connecting plate duct assemblies. These are connections which make the transition between the duct work, which is usually rectangular, and the generally circular heat exchanger and are attached to the sides of the hot and cold center sections. The housing panels are attached to and between these connecting plate duct assemblies thereby forming the housing. The housing panels are structural members of the overall air preheater framework and are somewhat complicated structures and thus shop assembled.

SUMMARY OF THE INVENTION

The present invention involves a housing arrangement for a rotary regenerative air preheater including ring assemblies at the upper and lower ends which define the outer periphery of the air preheater and which support the air preheater housing panels. The ring assemblies are spaced by spokes tied to the hub of the air preheater and vertically supported from the air preheater structural members. The simplified rotor housing panels are attached around and between these spoked ring assemblies. The ring assemblies support the peripheral bypass seals. The ring assemblies are formed from a series of uniform interchangeable segments.

DESCRIPTION OF THE PREFERRED EMBODIMENT

Figure 1:
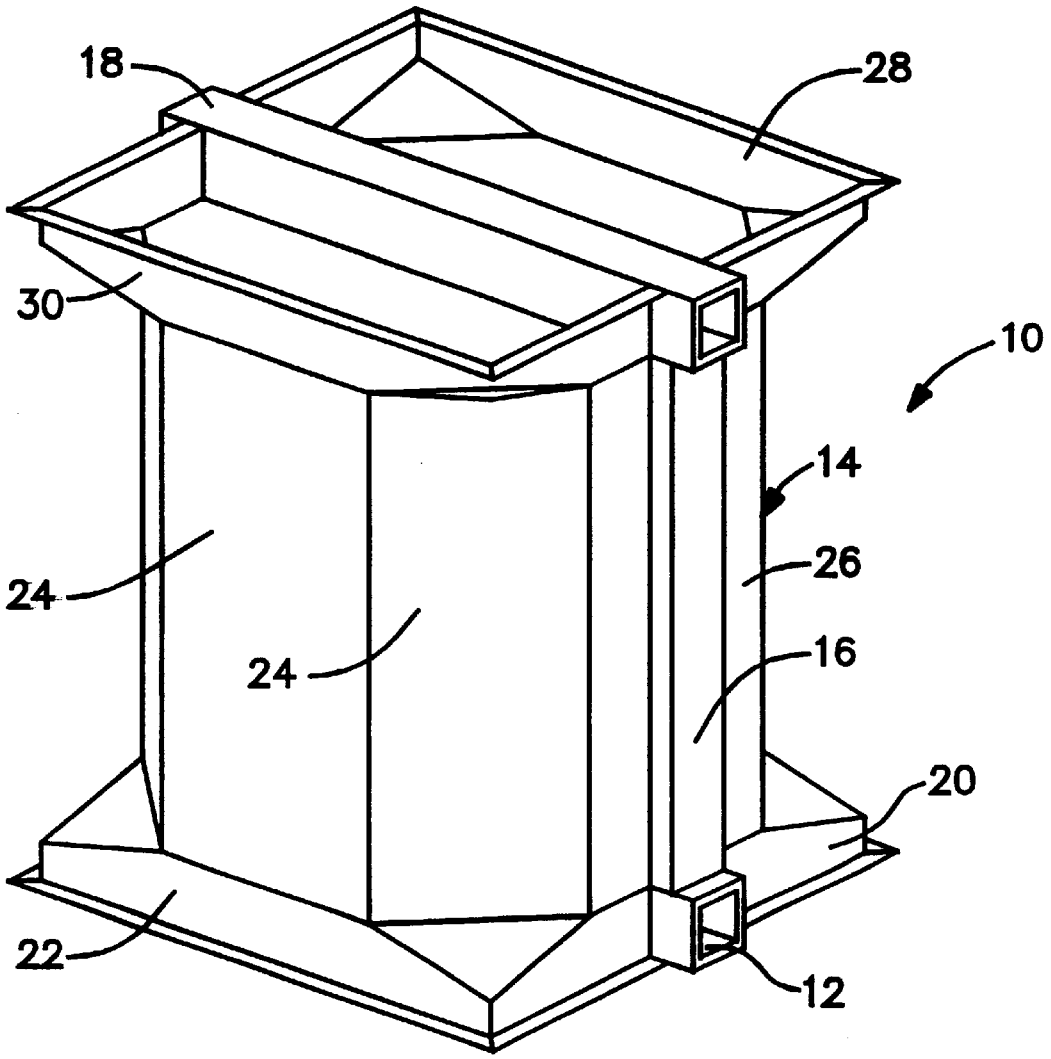
FIG. 1 is a perspective view of a prior art air preheater structure showing a multi-sided housing.

As background, FIG. 1 illustrates the external structure of a prior art rotary regenerative air preheater 10. At the bottom is the cold end center section 12 which supports the rotor (not shown) inside of the housing generally designated 14. The cold end center section 12 also supports the main support pedestal 16 which in turn supports the hot end center section 18. A corresponding main support pedestal is located on the back side. Mounted on the sides of the cold end center section 12 are the cold end connecting plate duct assemblies 20 and 22 which form the connections and the transition between the duct work of the steam generator and the housing of the air preheater.

Mounted on and extending upwardly from the cold end connecting plate duct assemblies 20 and 22 and the cold end center section 12 is the rotor housing 14 which is formed from the individual housing panels 24 and the two main support pedestal panels 26. The six housing panels 24 and the two main support housing panels 26 make up the octagonal shaped housing 14.

The hot end center section 18 supports the upper end of the rotor shaft. Mounted on the sides of the hot end center section are the hot end connecting plate duct assemblies 28 and 30 which serve the same purpose as the cold end connecting plate duct assemblies 20 and 22.

The housing panels 24 and 26 are heavy, fabricated structural members including reinforcing and stiffening ribs or beams. In the present invention, these housing panels of the prior art are replaced with a simplified arrangement.

Figure 2:
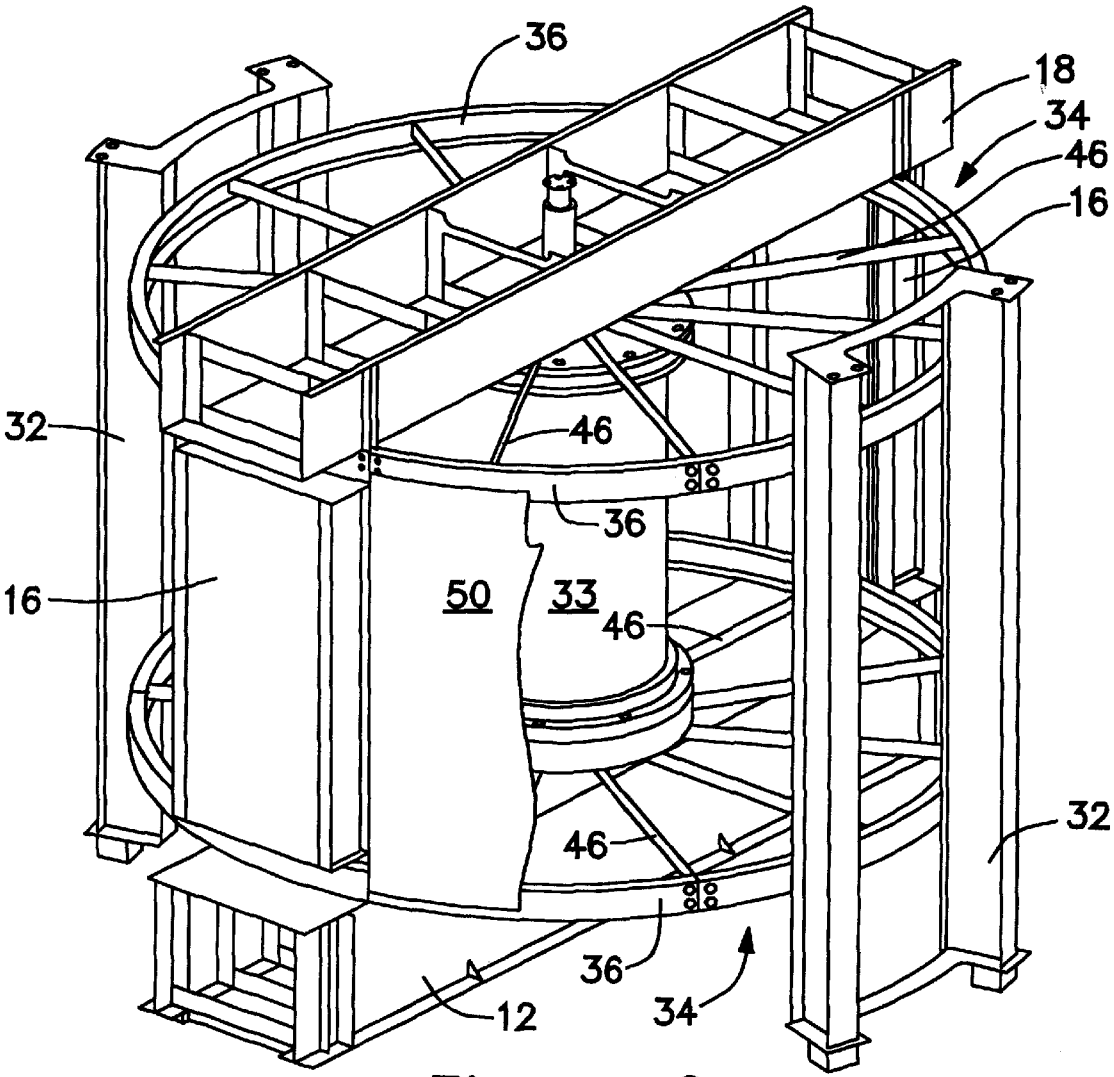
FIG. 2 is a perspective view of the framework of a rotary regenerative air preheater in accordance with the present invention.
Figure 3:
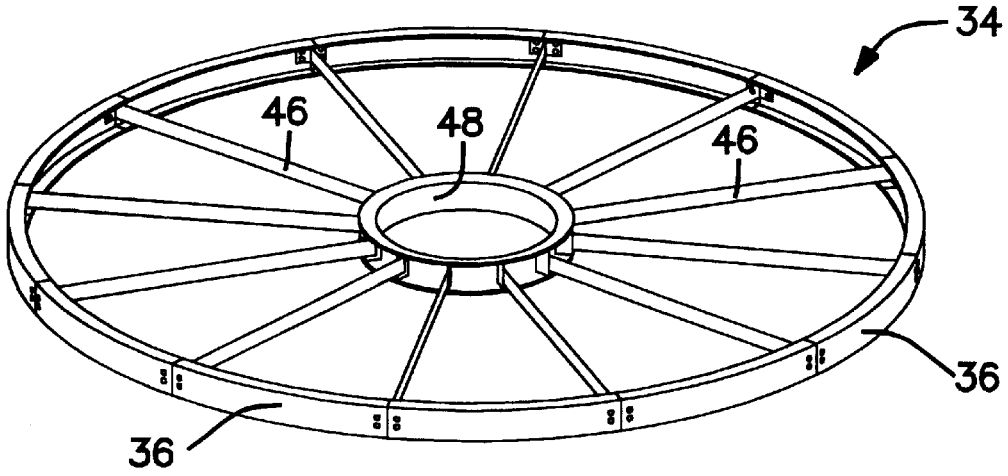
FIG. 3 is a perspective view of one of the ring assemblies.
Figure 4:
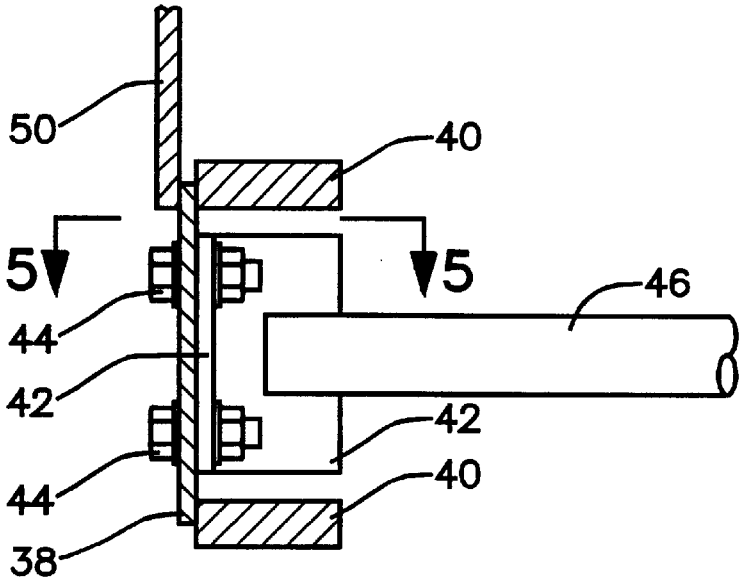
FIG. 4 is a vertical cross section through a portion of an air preheater according to the present invention illustrating a cross section of one of the ring assembly segments with a housing panel attached and showing a T-bracket for joining segments together and for attaching the spokes.
Figure 5:
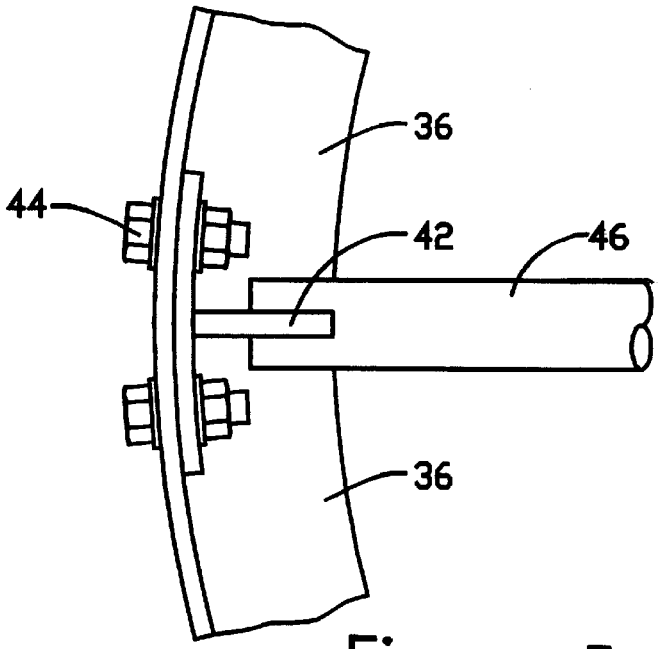
FIG. 5 is a horizontal cross section taken along line 5—5 of FIG. 4 showing a T-bracket and spoke.

FIG. 2 shows the framework of the housing of the rotary regenerative air preheater in accordance with the present invention. The structure is basically supported by the cold end center section 12, the main support pedestals 16 and the auxiliary support frames 32. Mounted on the cold end center section 12 and extending up to the hot end center section 18 is the rotor hub 33. Also mounted on the cold end center section 12 and defining the periphery of the rotor housing is the support ring assembly 34 which is also attached to the auxiliary support frames 32. This support ring assembly 34, which is shown in greater detail in FIGS. 3 and 4, comprises a plurality of ring segments 36 which are uniform and interchangeable. Each of the ring segments 36 forms a portion of the periphery of the rotor housing and comprises a U-shaped channel with the web 38 and the legs 40 as seen in FIG. 4. The ring segments 36 are bolted together with the T-shaped brackets 42 and the bolts 44. Attached to each of the T-shaped brackets 42 is a ring assembly spoke 46 which has a split end that fits over and is welded to the T-shaped bracket 42 as best shown in FIG. 5. These ring assembly spokes 46 are attached at their inner ends to the support ring assembly hub 48 in a similar manner. The bolted connections between the segments of the ring assemblies simplifies the field erection.

Figure 6:
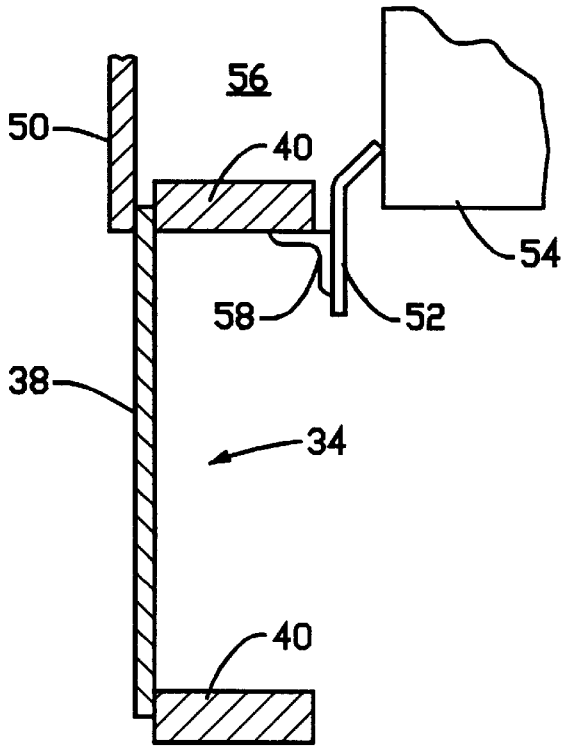
FIG. 6 is another vertical cross section showing a peripheral bypass seal attached to the ring assembly and a portion of the adjacent rotor.

Attached to the supporting ring assemblies 34 such as by welding are the rotor housing panels 50. These panels extend between the top and bottom support ring assemblies and form the rotor housing. Only a portion of one of these panels is shown in FIG. 2 so as not to cover up the framework. Portions of housing panels 50 are also shown in FIGS. 4 and 6. The housing panels 50 are merely flat plates rolled to conform to the circumference of the housing and mounted to form a round housing. The fabricated housing panel structures of the prior art are no longer needed and the number of parts and the weight is reduced.

FIG. 6 illustrates the mounting of the peripheral bypass seal 52 which extends all the way around the rotor and engages the rotor as represented at 54. This seal prevents the flue gas and air from bypassing the rotor in the annular space 56 between the rotor and the housing. The seal 52 is mounted on the brackets 58 attached at appropriate intervals to the support ring assembly 34. These peripheral bypass seals 52 are preferably located at both the top and bottom of the rotor.

What is claimed is:

1. In a rotary regenerative air preheater having a lower end center section, an upper end center section, support pedestals supporting said upper end center section from said lower end center section, a rotor having a lower end and an upper end and an axis of rotation extending between said lower and upper end center sections and a housing arrangement enclosing the periphery of said rotor wherein said housing arrangement comprises:

a. a lower end support ring assembly comprising:

i. a lower support ring extending around the periphery of said lower end of said rotor and supported at least in part by said lower end center section; and ii. a plurality of spokes having outer ends attached at intervals around said lower support ring and extending inwardly below said rotor and having inner ends attached around said axis of rotation to said lower end center section; and b. an upper end support ring assembly comprising:

i. an upper support ring extending around the periphery of said upper end of said rotor and supported at least in part by said support pedestals; and ii. a plurality of spokes having outer ends attached at intervals around said upper support ring and extending inwardly above said rotor and having inner ends attached around said axis of rotation to said upper end center section; and c. rotor housing panels extending between and around said lower and upper support rings and attached thereto thereby enclosing the periphery of said rotor.

2. In a rotary regenerative air preheater as recited in claim 1 wherein said lower and upper support rings comprise ring segments attached to each other to form said support rings.

3. In a rotary regenerative air preheater as recited in claim 2 wherein said ring segments are bolted to each other.

4. In a rotary regenerative air preheater as recited in claim 3 wherein brackets extend between adjacent ring segments and are bolted to said ring segments.

5. In a rotary regenerative air preheater as recited in claim 4 wherein said outer ends of said spokes are attached to said brackets.

6. In a rotary regenerative air preheater as recited in claim 5 wherein said inner ends of said spokes are attached to hubs and said hubs are attached to said lower and upper end center sections.

7. In a rotary regenerative air preheater as recited in claim 1 wherein said lower and upper support ring assemblies are further supported by additional support pedestals.

* * * * *